US005853052A

United States Patent [19]

Baiden et al.

[11] Patent Number: 5,853,052

[45] Date of Patent: Dec. 29, 1998

[54] HYDRAULIC DRIVE FOR ROTATION OF A ROCK DRILL

[75] Inventors: Gregory R. Baiden; Donald D. Young, both of Ontario, Canada

[73] Assignee: Inco Limited, Canada

[21] Appl. No.: 707,958

[22] Filed: Sep. 10, 1996

[51] Int. Cl.[6] ..... E21B 3/00

[52] U.S. Cl. ..... 173/15; 173/63; 173/78; 173/199; 173/216; 173/218; 173/184

[58] Field of Search ..... 173/15, 46, 73, 173/79, 80, 222, 218, 216, 213, 62, 63, 220, 279, 198, 199, 78, 184

[56] References Cited

U.S. PATENT DOCUMENTS

| | | | |
|---|---|---|---|
| 1,790,460 | 1/1931 | Capeliuschnicoff . | |
| 1,913,003 | 6/1933 | Shaff . | |
| 2,002,387 | 5/1935 | Bannister | 255/4 |
| 2,605,083 | 7/1952 | Collins | 173/198 |
| 2,660,402 | 11/1953 | Devine et al. | 255/4 |
| 2,937,007 | 5/1960 | Whittle | 255/4 |
| 2,937,008 | 5/1960 | Whittle | 255/4 |
| 3,076,514 | 2/1963 | Garrison | 175/107 |
| 3,623,558 | 11/1971 | Brown | 173/216 |
| 3,736,993 | 6/1973 | West | 173/216 |
| 3,774,697 | 11/1973 | Brown | 173/199 |
| 4,105,377 | 8/1978 | Mayall | 418/173 |
| 4,790,391 | 12/1988 | Hamamura et al. | 173/198 |
| 4,840,238 | 6/1989 | Klemm | 173/78 |
| 4,872,517 | 10/1989 | Shaw et al. | 173/218 |
| 5,131,476 | 7/1992 | Harrington | 173/78 |
| 5,370,194 | 12/1994 | Anderson | 173/213 |
| 5,437,338 | 8/1995 | Martin et al. | 173/222 |

FOREIGN PATENT DOCUMENTS

| | | |
|---|---|---|
| 1207686 | 5/1989 | Italy . |
| 1242231 | 3/1994 | Italy . |

*Primary Examiner*—Scott A. Smith
*Attorney, Agent, or Firm*—Blake T. Biederman; Edward A. Steen

[57] ABSTRACT

The invention provides an In-The-Hole hydraulic drive unit for rotating a rock drill. A hydraulic motor having a fixed rear trailing end and a rotating front drilling end converts hydraulic power into a rotational drive force. The hydraulic motor receives high pressure hydraulic fluid through a receiving inlet and discharges lower pressure hydraulic fluid through a hydraulic outlet. A drive shaft connected to the rotating front drilling end is disposed within the hydraulic motor. A fluid transfer conduit within the drive shaft transfers hydraulic or pneumatic drill fluid to power the rock drill. The fluid transfer conduit bypasses the hydraulic motor for independent supply and operation of the rock drill. The fluid transfer conduit receives the drill fluid from the surface and transfers the drill fluid toward the rock drill. The drive shaft contains a drill rotator attached to the front drilling end adapted to receive and rotate the rock drill.

16 Claims, 9 Drawing Sheets

HYDRAULIC DRIVE FOR ROTATION OF A ROCK DRILL

FIELD OF INVENTION

This invention relates to the field of rock drill operation. In particular, this invention relates to remote, in the hole rotation of a rock drill.

BACKGROUND OF THE INVENTION

In recent years, the underground mining industry has extensively used long-hole production methods to increase ore recovery rates and to reduce mining costs. Implementation of these methods has relied upon the accurate drilling of blastholes over distances ranging from about 70 to 140 meters. Conventional hardrock drilling equipment however, has no effective means for controlling the path of drilling equipment. As a result of this lack of directional control, excessive deviation of blastholes from their intended trajectories is a frequent, costly occurrence. The resulting incorrect positioning of explosives often causes unpredictable and inefficient blasting. This inefficient blasting results in poorly fragmented rock that accelerates the wear rate of ore handling and crushing equipment. Furthermore, inaccurate drilling may account for unacceptable levels of waste rock in the recovered ore. In summary, the entire mining process is adversely affected due to dilution and poor fragmentation of the recovered ore that directly or indirectly result from inaccurate drilling.

Presently, In-The-Hole (ITH) drills represent the state of the art in commercially available long-hole drilling technology. To operate an ITH drill, torque and axial thrust are transmitted to a hammer through a series of steel pipes or drill rods. The drill rods form a continuous shaft from the rotary drive head at the collar of the hole through to the hammer that drives the bit. These drill rods have a threaded connection that allows them to be joined in a long "string" as the hole gets deeper. The interior of the drill string carries the compressed air or water used in the operation of the ITH hammer. The exterior diameter of the string determines the annular area of the hole and consequently the velocity of the exhaust air or water. The drill rod is sized to allow appropriate fluid flow through the string and to provide sufficient exhaust velocity to bail the cuttings from the bottom of the hole to the surface. A power unit consisting of a prime mover (diesel, electric or air) that drives one or more hydraulic pumps is used to turn the drill string from the surface. The oil flow generated by the pump(s) is directed through appropriate valving to the various hydraulic actuators that control the functions required in the operation of the drill from the surface. Typical deviations for ITH drills are in the range of 10% of hole length. Consequently, ITH drills are extremely inaccurate for modern mining practices.

Typically, the drilling rate of production for ITH drills is approximately 0.3 meters minute, depending on the type of ore encountered and drill parameters. But the actual time required to drill a hole is much greater than this rate suggests. The drill string arrangement typically consists of 5 ft (1.64 m) long drill rods attached in series. After each 5 ft (1.64 m) increment of drilling, the drilling must be stopped to add another rod. To add a new drill rod, the drive head is decoupled from the previous rod and reset. A new rod is positioned and connected and the air in the string is brought back up to pressure before the drilling resumes. This procedure causes an interrupted drilling cycle and reduces the effective drilling rate considerably.

Replacing a drill string with a continuous flexible conduit would eliminate the drilling delay associated with connecting and disconnecting drill strings. But since rotating drill strings are used to rotate rock drills from the surface, surface powered rotation of a rock drill is not practical if a continuous flexible conduit replaces the drill string. Thus, when a continuous flexible conduit is used, it is essential to provide ITH rotation of a rock drill adjacent to the rock drill itself.

An early hydraulic drive unit for a well drilling tool is described by M. A. Capeliuschnicoff in U.S. Pat. No. 1,790,460 ('460). The '460 patent discloses the use of hydraulic mud flowing through the vanes of a hydraulic motor to turn a drill bit. W. Mayall, in U.S. Pat. No. 4,105,377 ('377), discloses a more recently designed hydraulic motor for a rock drill. The motor of the '377 patent uses a series of cylindrical rollers to provide a positive displacement, constant speed hydraulic motor. Additional drilling devices powered by vane driven hydraulic motors are disclosed by C. E. Bannister in U.S. Pat. No. 2,002,387, Devine et al. in U.S. Pat. No. 2,660,402 and M. A. Garrison in U.S. Pat. No. 3,076,514. The major disadvantage of all the above hydraulic drive unit designs is that a single supply of hydraulic fluid turns the motor, drives the bit and removes cuttings from the drill hole.

It is an object of this invention to provide an efficient low speed hydraulic motor for rotating a rock drill.

It is a further object of the invention to eliminate the need to periodically connect/disconnect drill strings while operating a long-hole drill.

It is a further object of the invention to provide a low speed hydraulic motor that includes an independent means for transporting fluid for operating a rock drill.

SUMMARY OF THE INVENTION

The invention provides an In-The-Hole hydraulic drive unit for rotating a rock drill. A hydraulic motor having a fixed rear trailing end and a rotating front drilling end converts hydraulic power into a rotational drive force. The hydraulic motor receives high pressure hydraulic fluid through a receiving inlet and discharges lower pressure hydraulic fluid through a hydraulic outlet. A drive shaft connected to the rotating front drilling end is disposed within the hydraulic motor. A fluid transfer conduit within the drive shaft transfers hydraulic or pneumatic drill fluid to power the rock drill. The fluid transfer conduit bypasses the hydraulic motor for independent supply and operation of the rock drill. The fluid transfer conduit receives the drill fluid from the surface and transfers the drill fluid toward the rock drill. The drive shaft contains a drill rotator attached to the front drilling end adapted to receive and rotate the rock drill.

DESCRIPTION OF PREFERRED EMBODIMENT

The invention provides a hydraulic drive unit for ITH rotation of drills used for long-hole drilling. Specifically, the hydraulic drive unit provides an independent conduit to supply fluid for independently operating a percussive hammer. The hydraulic drive unit may be powered by any compact hydraulic motor that turns a rock drill with a relatively high level of torque at a relatively slow rate. Although it is possible to power the invention with vane-driven hydraulic motors, it is preferred that a piston-driven hydraulic motor turn the rock drill.

Figure 1:
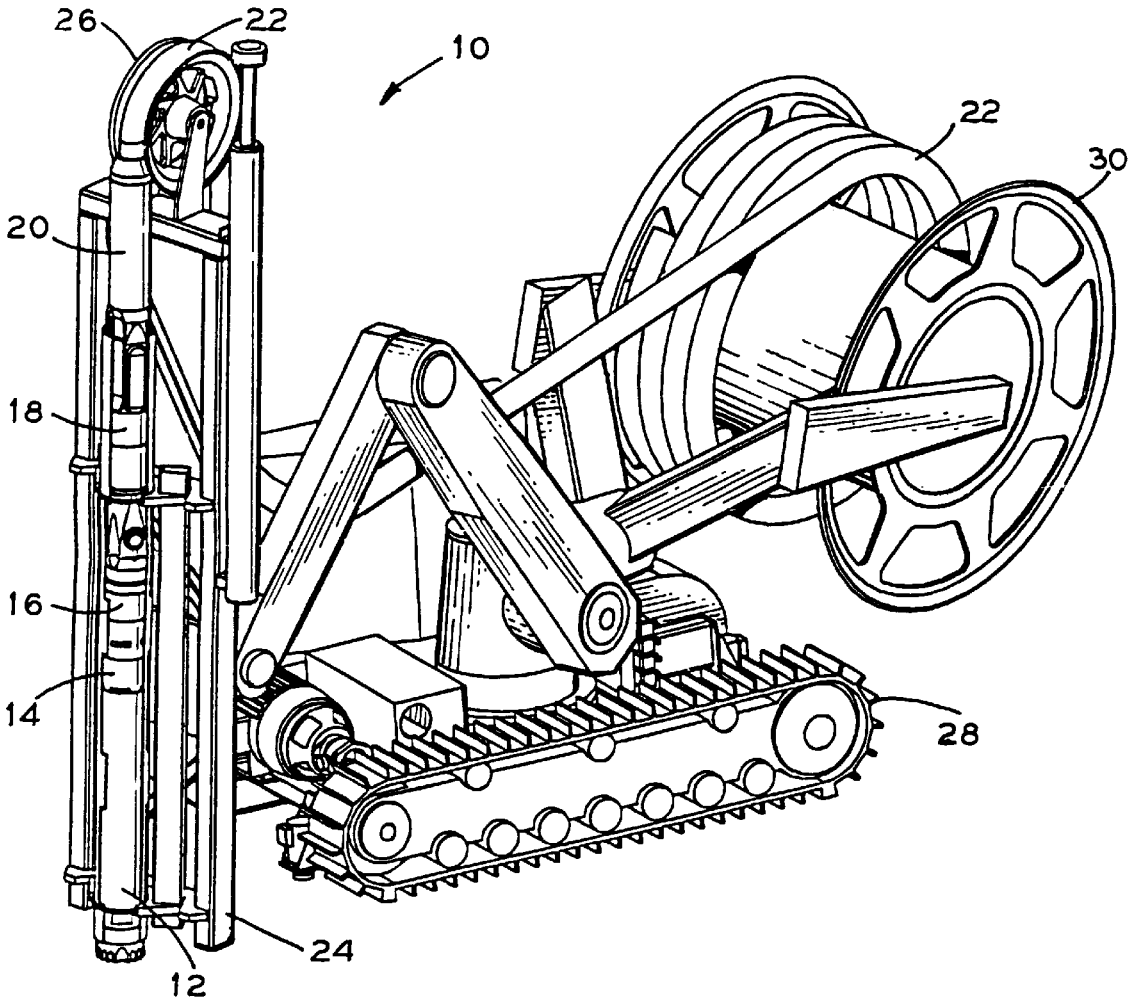
FIG. 1 is a perspective view of a guided drill system that contains the hydraulic drive unit of the invention.

Referring to FIG. 1, the hydraulic drive unit of the invention is most advantageously used as a component of guided drilling system 10. The guided drill system 10 consists of percussive hammer 12, shock absorber 14, hydraulic drive unit 16 and tractor 18. Percussive hammer 12 is transported and pressurized with tractor 18. Hydraulic drive unit drive 16 is used to rotate the percussive hammer 12 at a relatively slow rate. Shock absorber 14 protects sensitive equipment from the severe vibrations originating from percussive hammer 12. In addition, shock absorber 14 stores and returns mechanical energy for each compression cycle with percussive hammer 12. The tractor 18 is controlled and steered with control section 20. The control section 20 provides for accurate drilling through a predetermined drill route.

A flexible umbilical conduit 22 advantageously provides power supply lines and control lines to the drill. The supply lines supply hydraulic power, pneumatic power or a combination thereof. Most advantageously, percussive hammer 12 is operated with pneumatic power; and tractor 18 is operated with hydraulic power. The initial trajectory of the unit is established with support frame 24 and feed pulley 26. Advantageously, the guided drilling system is provided with means for self-propelled motion such as engine powered tracks 28. The flexible umbilical conduit 22 is advantageously designed with sufficient flexibility to be repeatedly coiled around and uncoiled from feed reel 30.

Figure 2:
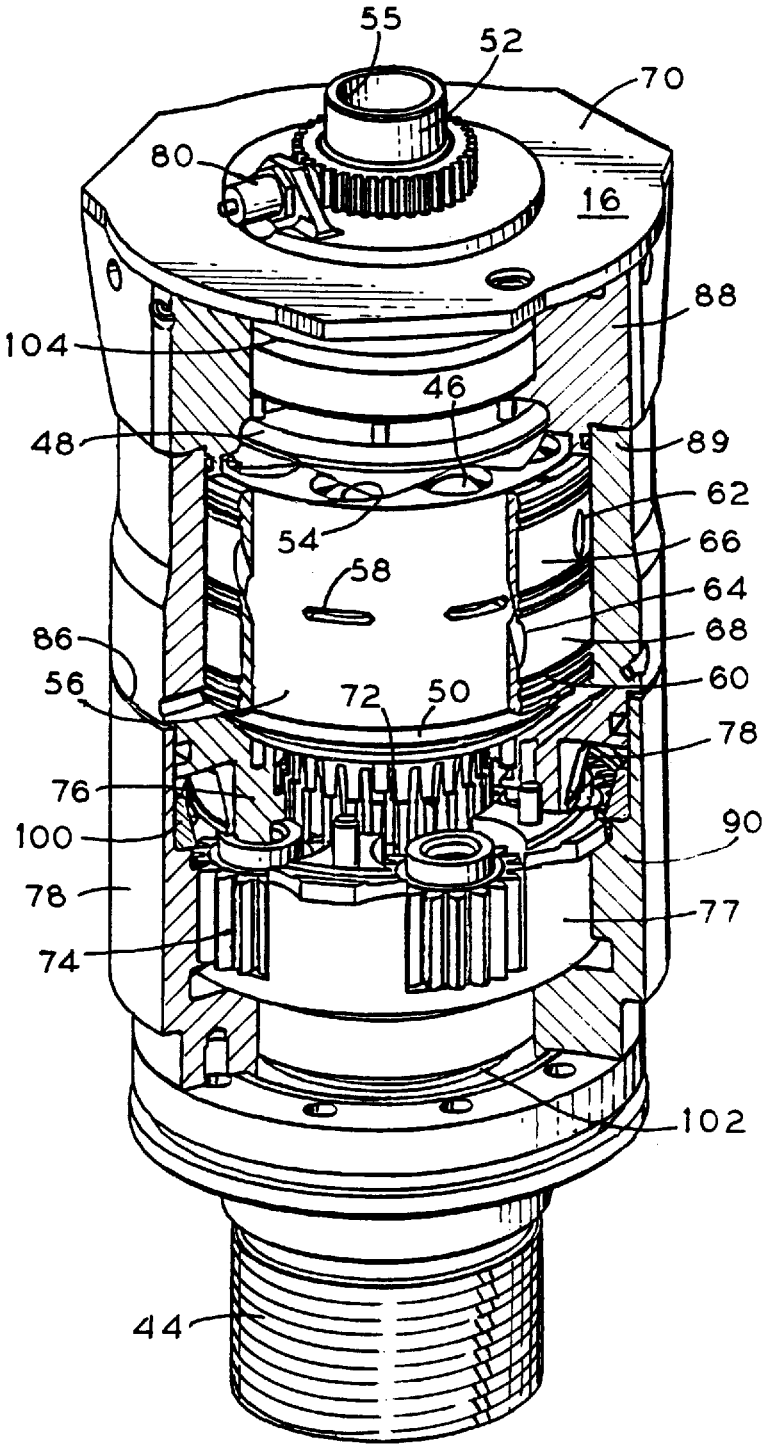
FIG. 2 is a perspective view of a hydraulic drive unit of the invention with portions partially broken away.

Referring to FIG. 2, hydraulic drive unit 16 is used to rotate a drill such as a percussive hammer at a controlled rate. Hydraulic drive unit 16 uses a hydraulic motor and reducing gears to turn drill rotator or drive end 44. Drive end 44 contains a drill rotator or connector specifically designed for receiving and rotating a shock absorber and rock drill. Opposing pistons 46 press against rear cam plate 48 and front cam plate 50 to rotate drive shaft 52. For purposes of this specification the term front defines the drilling end and the rear trailing end defines the end following the drilling end. The opposing pistons 46 are housed within cylinder bores 54 of barrel or cylinder block 56. Advantageously, cylindrically shaped cylinder bores are used to house cylindrically shaped pistons. Most advantageously, pistons 46 contain seals that prevent leakage of fluid between the pistons 46 and cylinder bores 54. It is particularly useful to minimize leakage of hydraulic fluid to optimize efficiency of the low-speed hydraulic motor.

The drive shaft 52 is disposed within the hydraulic motor. Most advantageously, the drive shaft is centrally disposed within the hydraulic motor. The drive shaft 52 is hollow to provide a fluid transfer conduit 55 for the transfer of hydraulic or pneumatic fluid from the surface to a rock drill attached to the front drilling end of the hydraulic drive unit. Most advantageously, drive shaft 52 and fluid transfer conduit 55 are constructed as a singular component. The fluid that is forced through fluid transfer conduit 55 completely bypasses the hydraulic motor. The fluid transfer conduit 55 may be used to transfer fluid to the rock drill at pressures independent of the pressure used to drive the hydraulic motor.

A front connector means is used to attach the rotating end to the rock drill. Most advantageously, the front connector means consists of a threaded bolt connection. The front connector means may consist of a bolted, grooved, flanged, threaded, welded or alternate device for fixed attachment of two components. In addition, a shock absorber is most advantageously placed between the front connector and the rock drill to protect the hydraulic drive unit from the intense pounding of the rock drill. A rear connector means attaches the fluid transfer shaft to a fluid source from the surface. The rear connector means may consist of a bolted, grooved, flanged, threaded, welded or alternate device for attaching a rotating conduit to a fixed conduit. Most advantageously, elastomeric seals are used to allow the rotating shaft to turn within a fixed conduit of a stabilized component such as a tractor unit.

To extend pistons 46, hydraulic fluid travels through cylinder block ports 58 under high pressure. Most advantageously, cylinder block ports 58 are radially slot-shaped to provide a smooth flow of hydraulic fluid. Timing sleeve assembly 60 contains inlet ports 62 and outlet ports 64. The inlet and outlet ports (62, 64) are angled inwardly to intersect cylinder block ports 58. Most advantageously, ports (62, 64) are cylindrically drilled at an extreme angle through timing sleeve assembly 60. Inlet groove 66 transfers fluid to the inlet ports 62. Similarly, outlet groove 68 transfers fluid from outlet port 64 for return to the surface.

As hydraulic fluid travels through inlet port 62, it most advantageously forces pistons outwardly against rear cam plate 48 and front cam plate 50. As pistons 46 are pressed against both cam plates, cylinder block 56 is rotated. The rotation of cylinder block 56 directly turns drive shaft 52. Most advantageously, drive shaft 52 is connected to cylinder block 56 with a splined connection. As the cylinder block continues to rotate, the pistons are reset for another power cycle. The inlet and return cycles alternate to provide a relatively slow speed/high torque rotation of drive shaft 52. Front cam plate 50, rear cam plate 48 and sleeve assembly 60 remain fixed or stationary during operation of the hydraulic motor. Most advantageously, top plate 70 is fixed to a tractor unit. The tractor unit grips the sidewalls of a drill hole to react against drive torque and prevent twisting of the flexible conduit that supplies hydraulic power to the hydraulic motor.

The hydraulic motor may contain any number of pistons and cam lobes that may be continuously operated to convert hydraulic power into rotational movement. Continuous rotational motion is accomplished through the geometrical relationships between cam plates (48, 50), timing sleeve ports (62, 64) and cylinder block porting 58. Most advantageously, nine pairs of pistons 46 are used in combination with rear cam plate 48 and front cam plate 50 to rotate the hydraulic motor. Most advantageously, the nine pairs of pistons 46 interact with seven lobe cams having a cam pitch diameter of 10 cm to provide the smooth, high torque motor. For example, the timing sleeve assembly 60 may be produced to constantly provide four pairs of pistons extending in opposite directions in a power stroke, four pairs of pistons retracting and one pair of pistons in a state of transition.

As the hydraulic motor turns shaft 52, it rotates sun gear 72, an integral part of shaft 52. The sun gear 72 is used to turn five planet gears 74. The sun gear 72 of this specific embodiment of the invention consisted of a 25 degree involute gear having a pitch of 10, 25 teeth and a face width of 1.25 in (3.2 cm). The sun gear 72 was matched with five 25 degree type involute planet gears 74 having a pitch of 10, 17 teeth and a face width of 1.375 in (3.5 cm). Finally, the planet gears 74 were used to drive a 25 degree type involute (internal) ring gear 78 having a pitch of 10, 60 teeth and a face width of 1.25 in (3.2 cm). The planet gears 74, mounted between spindles 76 and spindle cage 77, are used to turn ring gear 78 with a relatively high amount of torque. The spindle cage 77 effectively reduces deflection of planet gears 74. Most advantageously, all of the gears are machined from premium quality steel with carburized and ground tooth profiles. It is recognized that the above gears may be varied to provide the desired speed and torque of the drive shaft 52. The reduction ratio of the gears was 60/25 or 2.4. This 2.4 factor of reduction decreases the counter-clockwise motor rate of about 48 rpm to turn a drive shaft clockwise at about 20 rpm and increases torque by the same ratio. In the specific embodiment of the invention illustrated, clockwise rotation is required to keep the right handed threads of the shock absorber and hammer from unwinding.

The fluid transfer conduit 55 rotates with drive shaft 52 in a counter-clockwise direction. The fluid transfer conduit 55 however, extends through the drive shaft 52 and drive end 44 that rotate in opposite directions. A rotating connection is used to connect the front clockwise rotating drive end 44 to the rear counter-clockwise rotating section of the fluid transfer conduit 55. Most advantageously, an elastomeric seal is used to prevent fluid from escaping through this connection.

The speed of the hydraulic motor is advantageously monitored with sensor 80. Most advantageously, sensor 80 is hard wired to the control system for monitoring the speed of the hydraulic motor. The hydraulic flow rate is then readily adjusted by the control system to optimize the rate of rotation. However, the hydraulic motor is primarily designed for constant rotation. Since the torque required to turn the bit varies with the type of rock and drill used, the flow may be varied to rotate the hydraulic motor at a constant rate. The hydraulic motor of the invention can maintain at least a 1500 ftlb (2,030 N·m) motor torque by maintaining 2600 psi (17.9 MPa) pressure differential between the hydraulic inlet and return. Since a small amount of hydraulic fluid leaks into the gears, lubricating oil is most advantageously used to drive hydraulic motor to lengthen the service life of the hydraulic drive unit.

The sleeve assembly most advantageously contains threaded holes for simplified removal from its housing. Alternately, the sleeve assembly may simply be press-fit into the housing. The gap 86 divides the stationary or fixed housings (88, 89) from rotating housing 90 and ring gear 78. To facilitate the compact construction, front fixed housing 89 and spindles 76 are most advantageously machined as a single component. Similarly, rotating housing 90 and ring gear 78 are most advantageously machined as a single component.

Figure 3:
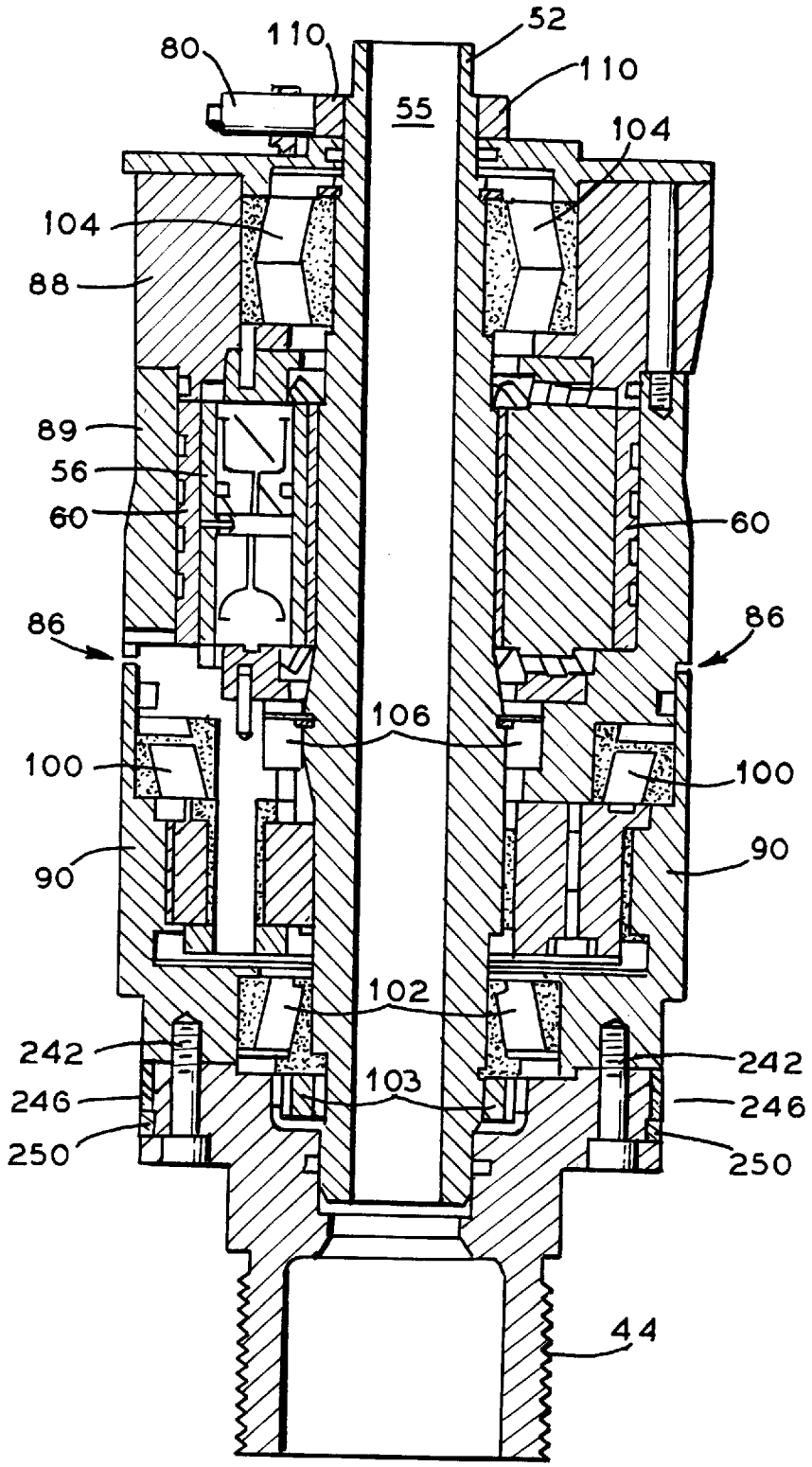
FIG. 3 is a cross section of the hydraulic drive unit of the invention.

Referring to FIG. 3, a series of bearings and seals allow the hydraulic motor to rotate drive end 44 under large pressures without binding or buckling. The outer tapered bearing 100 is used to support the downward thrust of fixed housings (88, 89) against a drill connected to drive end 44. Front tapered roller bearing 102 and outer tapered roller bearing 100 combine to support the bending moment. Furthermore, the front tapered bearing 102 advantageously combines with rear bearing 104 to bear the axial separation force arising from oil pressure in the gear chamber. Most advantageously, rear bearing 104 is constructed with a tapered roller bearing (FIGS. 2 and 4A) rather than the spherical roller bearing of FIG. 3. Furthermore, the rear tapered bearing 104 and the cylindrical bearing 106 combine to bear the load originating from the moment around drive shaft 52. Finally, one or more cylindrical roller bearing 106 and bearing 104 serve to centralize drive shaft 52. Seal 110 prevents the flow of high pressure hydraulic fluid from flowing into drive shaft 52. In addition, another seal (not illustrated) adjacent bearing nut 103 prevents the flow of high pressure hydrualic fluid from entering the front end of drive shaft 52.

Figure 4A:
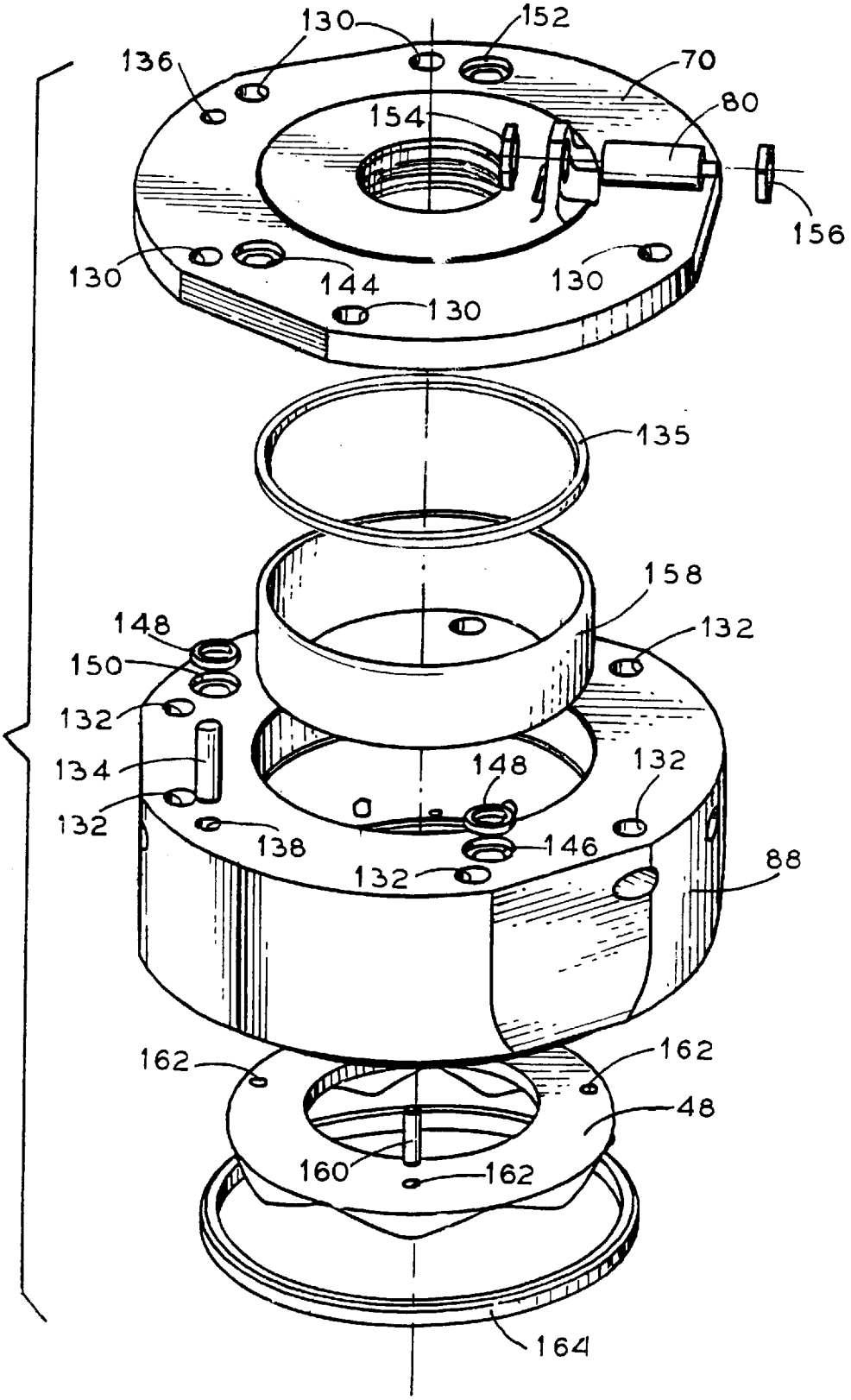
FIG. 4A is an exploded perspective view of a rear fixed housing (with a rotated top plate) and components fixed to or adjacent to the rear fixed housing.

Referring to FIG. 4A, housing 88 is secured to top plate 70 with six bolts that are connected through plate holes 130 and housing holes 132. Alignment dowel 134 is secured through alignment holes 136 and 138 to ensure proper alignment of the hydrualic motor. The entire top plate 70 is sealed to rear fixed housing 88 with O-ring 135.

During operation, hydraulic fluid travels through inlet 144 and transfer conduit 146. Most advantageously, O-rings 148 are used to prevent leakage between connections of the hydraulic lines entering and returning from the hydraulic drive unit. The hydraulic fluid travels through transfer conduit 146, that is divided into multiple separate conduits within rear fixed housing 88. The multiple separate conduits exit into front fixed housing 89 (FIG. 4B) for operation of a hydraulic motor. The hydraulic fluid returns through a hydraulic return conduit 150 to return outlet 152 for return to a surface powered hydraulic pump for continuous operation of the hydraulic motor. The return conduit 150 receives fluid from multiple conduits that are combined into a single conduit within rear fixed housing 88 for transfer to the surface. Speed sensor 80, connected with lock nuts 154 and 156, most advantageously continuously monitors the rotation rate of the motor.

The bearing cup 158 of the rear tapered bearing provides for smooth rotation of the shaft within rear fixed housing 88. The rear cam 48 is advantageously secured with alignment dowels 160 through cam connection holes 162. Most advantageously, at least five alignment dowels are used to secure the cams to the fixed housing. A bronze wear ring 164 is used within the housing 88 to reduce or eliminate steel on steel friction.

Figure 4B:
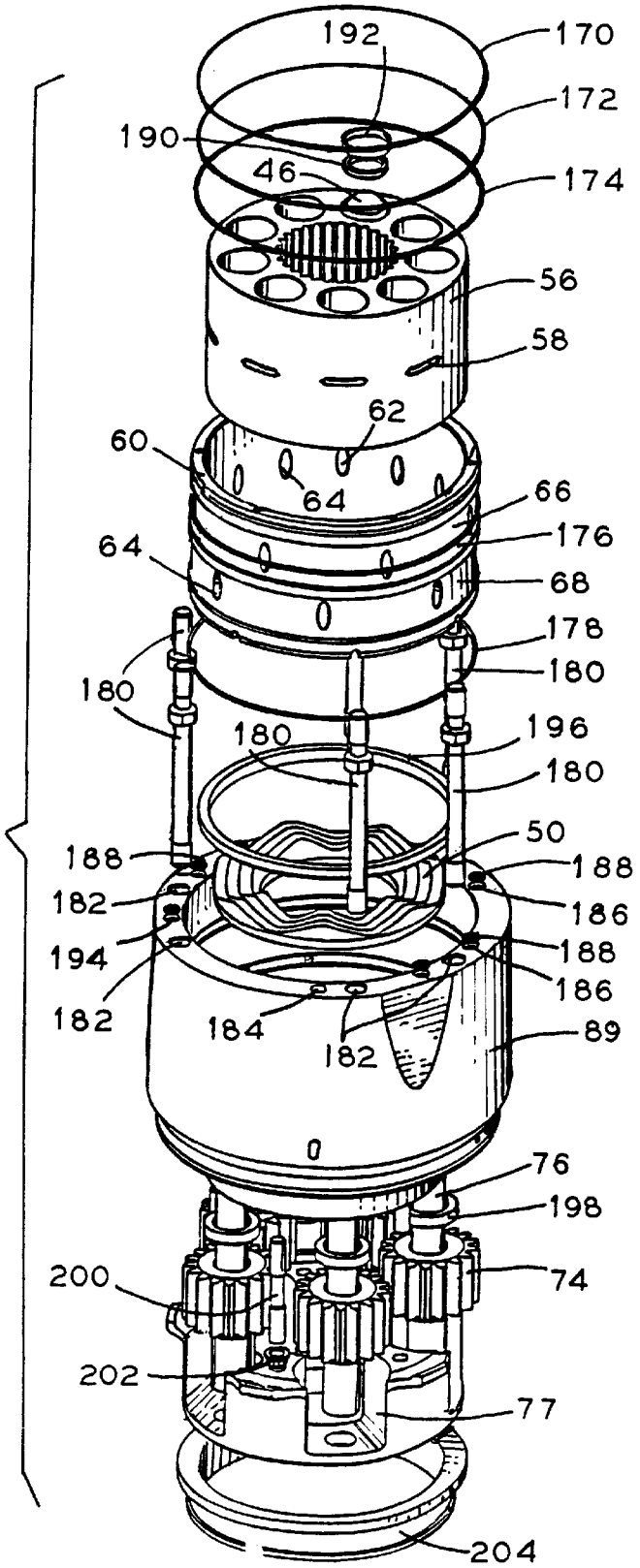
FIG. 4B is an exploded perspective view of the front fixed housing, the planet gear assembly and components fixed to or adjacent thereto with portions broken away.

Referring to FIG. 4B, the timing sleeve 60 utilizes O-rings 170, 172 and 174 in combination with retainer rings 176 and 178 to separate inlet groove 66 and from outlet groove 68. The bolts 180 are advantageously used to secure top plate 70, (FIG. 4A), rear fixed housing 88 (FIG. 4A) and front fixed housing 89. The bolts 180 are connected through holes 182 of front fixed housing 89. Alignment hole 184 is used in combination with a dowel to ensure proper alignment of the fixed housing. Most advantageously, bolts 180 are also used to secure fixed housing to a tractor.

During operation, hydraulic fluid travels from the rear fixed housing into multiple inlet conduits 186 sealed with O-rings 188. The high pressure hydraulic fluid travels through inlet conduit 186 to inlet groove 66. The fluid then travels through timing sleeve inlets 62 to cylinder block ports 58. The inlet ports push the upper pistons 46 against the cams of FIG. 2. Seals 190 and 192 are most advantageously used to seal each piston 46. (For purposes of illustration only one of the eighteen pistons is visible in FIG. 4B). The lower pistons press against front cam 50 to rotated internally splined cylinder block 56. Wear ring 196 combines with wear ring 164 (FIG. 4A) to reduce wear between housings (88, 89) and the cylinder block. Most advantageously, the wear rings are constructed of a low friction material such as bronze. The return fluid travels through return ports 64, to return groove 68 into return conduits 194 of housing 89. The hydraulic fluid returns through multiple return conduits 194 to the return conduit of housing 89 for return to the surface.

The planet gears 74 are fixed to housing 89 on spindles 76. Spacers 198 and bushings (not illustrated) are used to prevent planet gears 74 from rubbing against the housing. Spindle cage 77 is advantageously connected to housing 89 with three studs 200 and nuts 202. Bearing cup 204 of the outer roller bearing 100 (FIG. 3) is also visible in FIG. 4B.

Figure 4C:
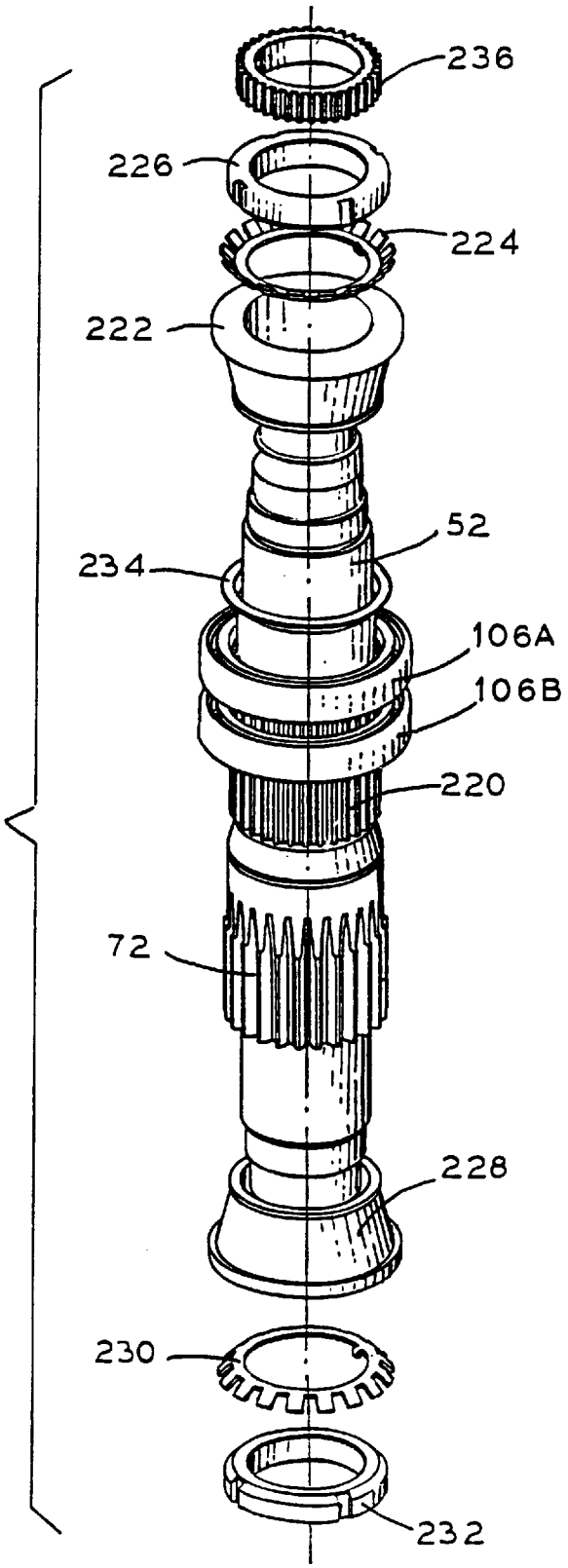
FIG. 4C is an exploded perspective view of the drive shaft and components fixed to or adjacent to the drive shaft.

Referring to FIG. 4C, the hydraulic motor turns the splined connection 220 of drive shaft 52. The rear tapered roller bearing contains cone 222, tab washer 224 and bearing lock nut 226. Similarly, the front tapered roller bearing contains cone 228, tab washer 230 and bearing lock nut 232. Most advantageously the tapered roller bearings are of a cup and cone design. (Rollers and cage are not illustrated on each cone of the drawings.) The snap ring 234 is used to secure cylindrical bearings 106A and 106B in position. Most advantageously, cylindrical roller bearings 106A and 106B act together as a single cylindrical roller bearing. The timing gear 236 attached to drive shaft 52 is used in combination with the speed sensor to measure speed of the drive shaft.

Figure 4D:
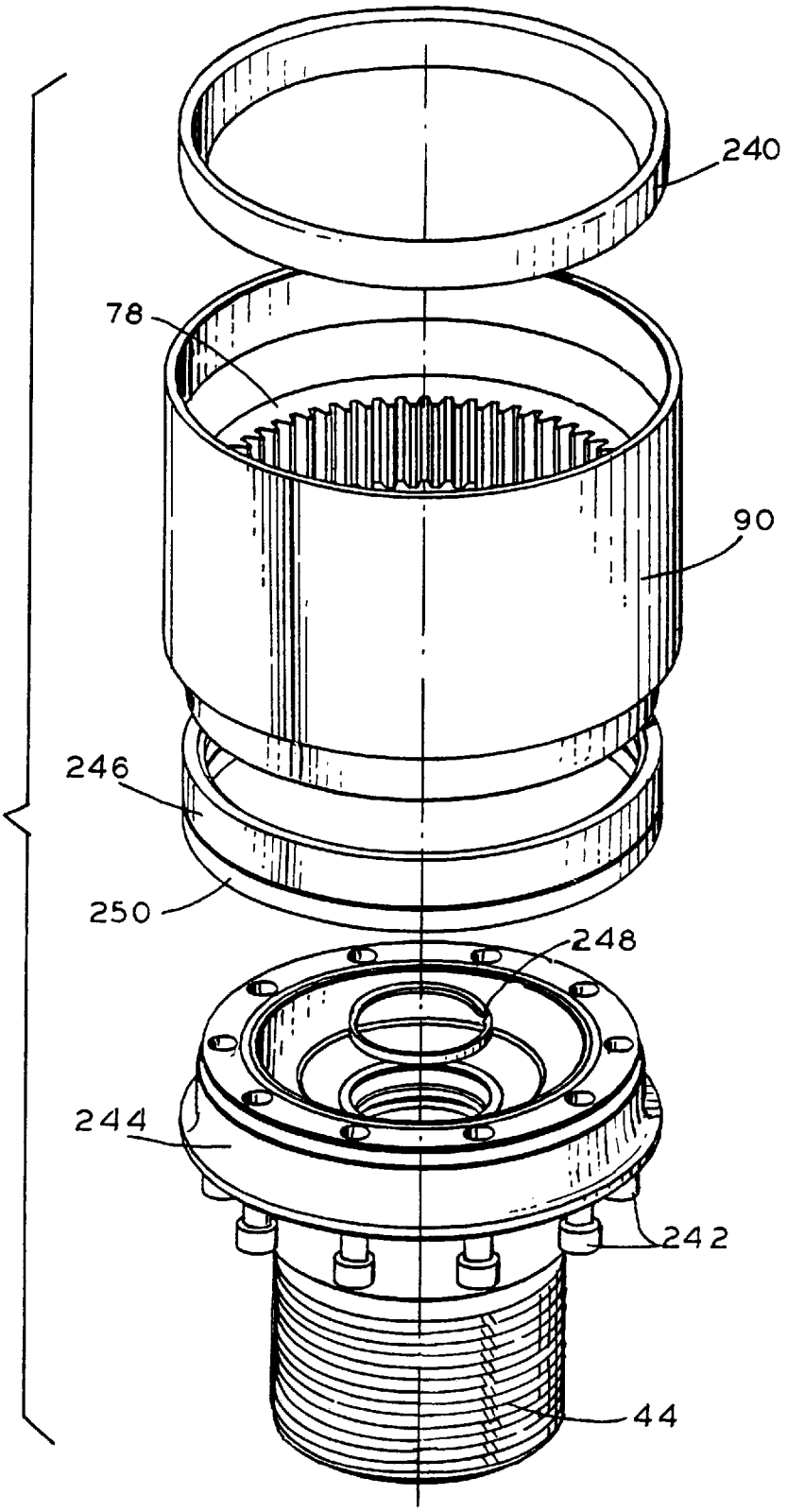
FIG. 4D is an exploded perspective view of the ring gear assembly and components fixed to or adjacent to the ring gear assembly.

Referring to FIG. 4D, the ring gear 78 is used to turn the hammer. The cup 240 of the outer tapered roller bearing fits within the upper recess of ring gear 78. Connection bolts 242 are most advantageously used to connect a shock absorber and shock absorber adapter 244 to rotating housing 90. The shock absorber adapter 244 acts as a drill rotator connection by rotating both the shock absorber and the drill. The spacer ring 246 is used to protect elastomeric wiper seal 250 between rotating housing 90 and shock absorber adapter 244. Alternately, the ring gear may be attached directly to a percussive hammer. However, it is preferred that a shock absorber be used to minimize wear of the trailing components. The seal ring 248 allows the drive shaft to rotate within shock absorber adapter 244. The elastomeric wiper seal 250 faces outwards to prevent dirt from entering between the vibrating portion of the shock absorber and shock absorber adapter 244.

Figure 5:
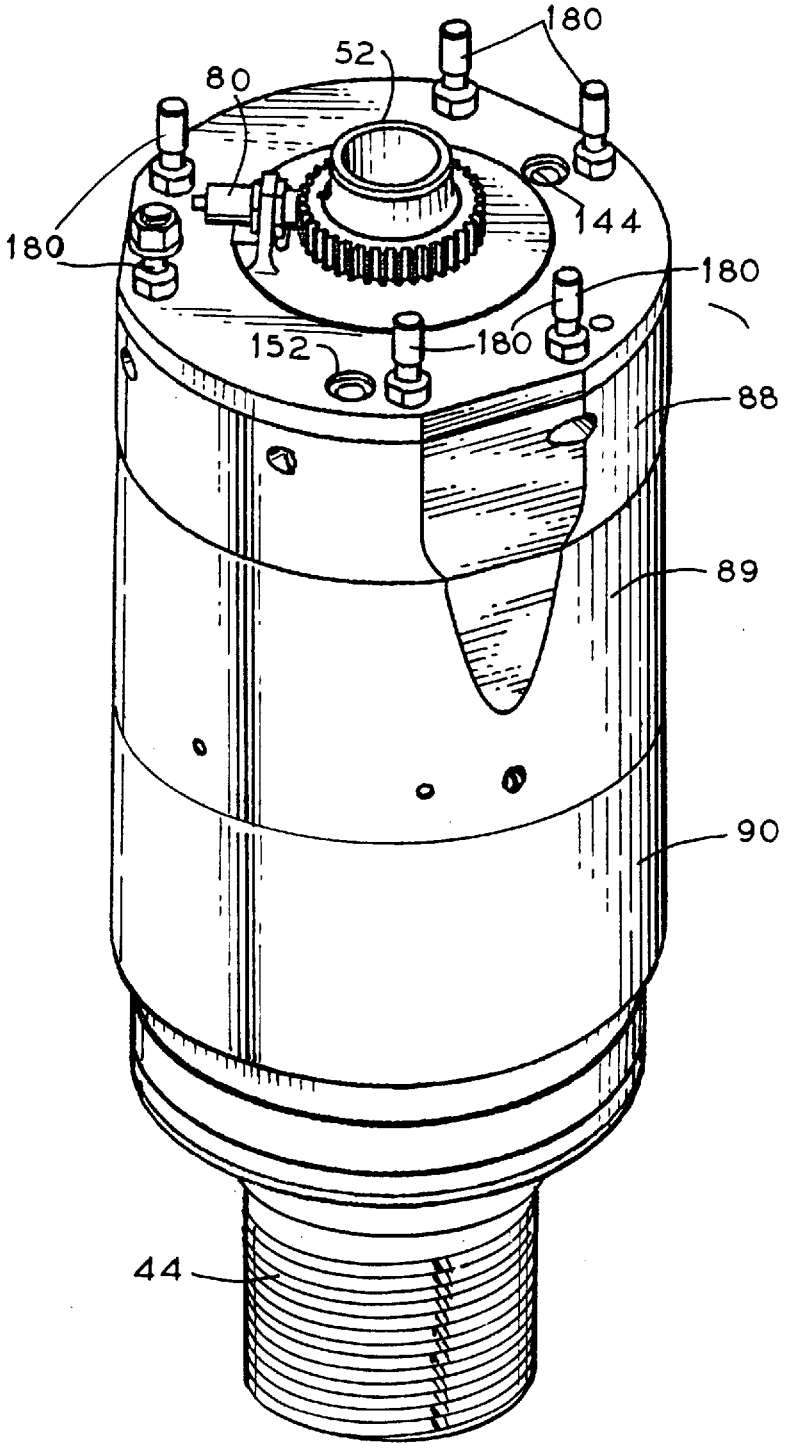
FIG. 5 is a perspective view of the hydraulic drive unit of the invention.

Referring to FIG. 5, the entire hydraulic drive unit provides a compact, tightly sealed ITH power unit for a rock drill. The cylindrical outer housing facilitates removal of rock chips between the drill hole and the hydraulic drive unit. Most advantageously, rock chips are pneumatically removed between the motor housing and the drill hole wall with pneumatic fluid that first powered a percussive rock drill.

Figure 6:
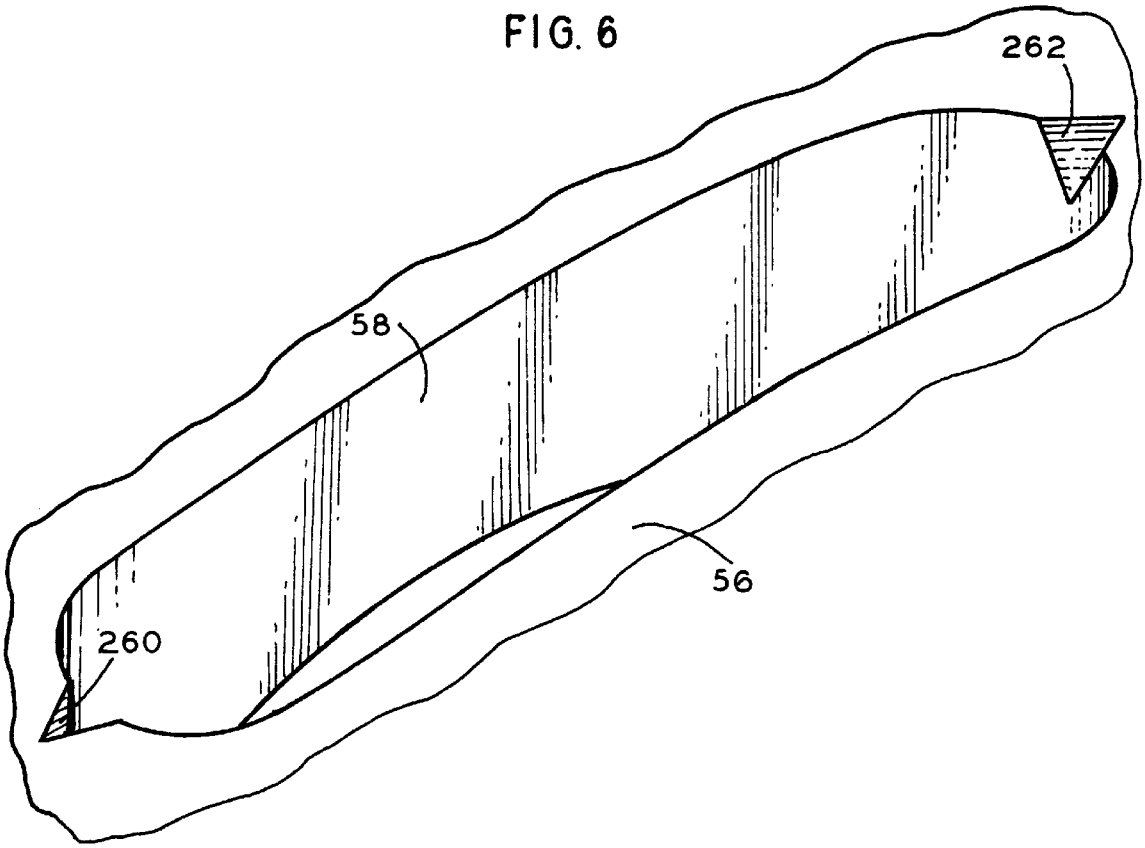
FIG. 6 is a perspective view of a notched cylinder block port.

Referring to FIG. 6, the cylinder block ports 58 of cylinder block 56 most advantageously contain small relief notches (260, 262) at the leading and trailing ends. The small relief notches (260,262) create a smooth transition between receiving fluid through inlet ports and discharging fluid through outlet ports of the timing sleeve. This smooth transition between cycles facilitates the maintaining of a relatively constant rate of rotation at an essentially constant torque.

The invention provides a hydraulic motor containing a drive shaft and a separate fluid transfer conduit for supplying fluid to power a rock drill. The hydraulic drive unit allows the operation of a pneumatic or hydraulic rock drill. In addition, the hydraulic drive unit of the invention allows separate fluid flow rates to simultaneously operate a hydraulic motor and a rock drill. The separate operating flow rates facilitate independently optimizing rotation rate of the hydraulic drive unit and the hammer rate of a percussive drill. The hydraulic drive unit provides for the high torque, low speed rotation of a rock drill at a relatively constant rate. If the rock drill is connected to a long flexible conduit, its hydraulic power eliminates the burden of periodically connecting and disconnecting drill strings.

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A hydraulic drive unit for rotating a rock drill from within a drill hole comprising:

a hydraulic motor, said hydraulic motor having a fixed rear trailing end and a rotatable front drilling end, said hydraulic motor having a hydraulic inlet for receiving hydraulic fluid and a hydraulic outlet for discharging hydraulic fluid, a drive shaft disposed within said hydraulic motor, said drive shaft having a rear trailing end connected to said rotating front drilling end of said hydraulic motor and a front drill connecting end opposite said rear trailing end, a fluid transfer conduit within said drive shaft, said fluid transfer conduit bypassing through said hydraulic motor for the independent supply of a drill fluid to power the rock drill by receiving the drill fluid and transferring the drill fluid toward the rock drill, and a front connector means attached to said front drill connecting end of said drive shaft for connecting to the rock drill.

2. The hydraulic drive unit of claim 1 wherein said hydraulic motor contains pistons for driving said hydraulic motor.

3. The hydraulic drive unit of claim 1 wherein opposing pistons drive said hydraulic motor.

4. The hydraulic drive unit of claim 3 wherein said pistons have ball ends that press against cams to drive said hydraulic motor.

5. The hydraulic drive unit of claim 1 wherein a sun gear, planet gears and a ring gear are connected between said hydraulic motor and said drive shaft for decreasing the rate of rotation of said drive shaft and increasing torque of said drive shaft.

6. The hydraulic drive unit of claim 1 wherein bearings are used to bear the load arising from thrusting the hydraulic drive unit against the rock drill.

7. The hydraulic drive unit of claim 1 wherein a percussive drill is connected to said front connector means.

8. The hydraulic drive unit of claim 7 wherein a flexible conduit provides fluid to a rear trailing end of said fluid transfer conduit.

9. The hydraulic drive unit of claim 8 wherein said fluid transfer conduit is connected to a source of pneumatic power for powering said percussive drill.

10. A hydraulic drive unit for rotating a rock drill from within a drill hole comprising:

a hydraulic motor powered by opposing pairs of pistons, said hydraulic motor having a fixed rear trailing end and a rotatable front drilling end, said hydraulic motor having a hydraulic inlet for receiving hydraulic fluid and a hydraulic outlet for discharging hydraulic fluid, a drive shaft centrally disposed within said hydraulic motor, said drive shaft having a rear trailing end connected to said rotating front drilling end of said hydraulic motor and a front drill connecting end opposite said rear trailing end, a fluid transfer conduit within said drive shaft, said fluid transfer conduit bypassing through said hydraulic motor for the independent supply of a drill fluid to power the rock drill by receiving the drill fluid and transferring the drill fluid toward the rock drill, and a front connector means attached to said front drill connecting end of said drive shaft for connecting to the rock drill.

11. The hydraulic drive unit of claim 10 wherein said pistons have ball ends that press against cams to drive said hydraulic motor.

12. The hydraulic drive unit of claim 10 wherein a sun gear, planet gears and a ring gear are connected between said hydraulic motor and said drive shaft for decreasing the rate of rotation of said drive shaft and increasing torque of said drive shaft.

13. The hydraulic drive unit of claim 10 wherein bearings are used to bear the load arising from thrusting the hydraulic drive unit against the rock drill.

14. The hydraulic drive unit of claim 10 wherein a percussive drill is connected to said front connector means.

15. The hydraulic drive unit of claim 14 wherein a flexible conduit provides fluid to a rear trailing end of said fluid transfer conduit.

16. The hydraulic drive unit of claim 15 wherein said fluid transfer conduit is connected to a source of pneumatic power for powering said percussive drill.

* * * * *